US005246909A

United States Patent [19]

Thien et al.

[11] Patent Number: 5,246,909

[45] Date of Patent: Sep. 21, 1993

[54] DYE TRANSFER MEDIA

[75] Inventors: Tran V. Thien, Harlow; Ranjan C. Patel, Little Hallingbury, both of Great Britain

[73] Assignee: Minnesota Mining and Manufacturing Company, St. Paul, Minn.

[21] Appl. No.: 809,795

[22] Filed: Dec. 18, 1991

[30] Foreign Application Priority Data

Dec. 18, 1990 [GB] United Kingdom ..... 9027443

[51] Int. Cl.[5] ..... B41M 5/035; B41M 5/38

[52] U.S. Cl. ..... 503/227; 427/152; 428/195; 428/474.4; 428/478.2; 428/500; 428/520; 428/532; 428/913; 428/914; 430/200; 430/201; 430/945

[58] Field of Search ..... 8/471; 428/195, 913, 428/914, 474.4, 478.2, 500, 520, 532; 503/227; 427/152; 430/200, 201, 945

[56] References Cited

U.S. PATENT DOCUMENTS

| | | | |
|---|---|---|---|
| 4,700,208 | 10/1987 | Vanier et al. | 503/227 |
| 4,716,144 | 12/1987 | Vanier et al. | 503/227 |
| 4,740,496 | 4/1988 | Vanier | 503/227 |
| 4,853,365 | 8/1989 | Jongewaard et al. | 503/227 |
| 4,857,503 | 8/1989 | Jongewaard et al. | 503/227 |
| 4,977,134 | 12/1990 | Jongewaard et al. | 503/227 |

FOREIGN PATENT DOCUMENTS

| | | | |
|---|---|---|---|
| 0120230 | 3/1984 | European Pat. Off. | 428/195 |
| 0227091A3 | 12/1986 | European Pat. Off. | 503/227 |
| 0228065A3 | 12/1986 | European Pat. Off. | 503/227 |
| 0227091 | 1/1987 | European Pat. Off. | 503/227 |
| 0228065 | 8/1987 | European Pat. Off. | 503/227 |
| 0314349 | 3/1989 | European Pat. Off. | 503/227 |
| 2083726A | 3/1982 | United Kingdom | 503/227 |

OTHER PUBLICATIONS

Patent Abstracts of Japan, vol. 13, No. 90 (M-803)(3438) Mar. 2, 1989.

*Primary Examiner*—B. Hamilton Hess

*Attorney, Agent, or Firm*—Gary L. Griswold; Walter N. Kirn; Mark A. Litman

[57] ABSTRACT

A dye-transfer-sheet in the form of a self supporting film having a total thickness of from 4 to 15 μm and consisting of a layer of one or more thermally mobile sublimation dyes dissolved or dispersed in a polymeric binder and a hydrophilic barrier layer adjacent to, but distinct from the dye-containing layer comprising a polymeric binder substantially impermeable to migration of the sublimable dye(s).

The dye-transfer-sheets have a high sensitivity due to the absence of a separate support substrate and are capable of producing clear, high density transferred images.

19 Claims, No Drawings

DYE TRANSFER MEDIA

FIELD OF THE INVENTION

This invention relates to dye-transfer-media and in particular to dye-transfer-sheets comprising a thermally mobile sublimation dye in the form of a self-supporting film. The transfer-sheets of the invention comprise a dye donor layer in association with a barrier layer substantially impermeable to migration of the dye, thereby facilitating unidirectional transfer of dye.

BACKGROUND TO THE INVENTION

Sublimation dye media generally comprise a support having coated thereon in one or more layers a dye donor layer comprising a thermally mobile sublimation dye dispersed or dissolved in a polymeric binder, and are becoming very important for producing colour images, especially with color gradation. In particular, sublimation dye media are being combined with thermal printheads to produce digital colour hardcopy by sequential deposition of yellow, magenta and cyan dyes. To obtain the copy, a cyan, magenta or yellow dye-transfer-medium is placed in face-to-face contact with an image (dye-receiving) receptor. The assembly of media and receptor is then inserted between the thermal print head and a platen roller. A line-type thermal print head is used to apply heat from the back, i.e., the uncoated surface of the support of the media, to cause dye transfer in the heated areas. The thermal print head typically comprises a plurality of heating elements and is heated up sequentially in response to the signals transmitted to the print head. The process is then repeated for the remaining two colours to obtain a full colour hard copy of the original image. Further details of this process and apparatus for carrying it out are contained in U.S. Pat. No. 4,621,271 entitled Apparatus and Method for Controlling a Thermal Printer Apparatus. Such a process, however, requires the use of a thin substrate for the dye-transfer-medium in order to maximise the operation of the thermal printhead which prints pixels in a matter of milliseconds. Thus, highly sensitive media on thin substrates, i.e., 8 μm or less, need to be designed, which do not suffer from shelf life constraints. Less sensitive media, on thicker, more easily coatable substrates, i.e., 10 μm or greater, are found to increase wear and tear of the printhead.

It is also known to incorporate infrared absorbing materials in the dye-donor layer to allow imaging via exposure to an infrared laser, such as a laser diode. The infrared absorbing material generates heat in the exposed areas, causing dye transfer in those areas. British Patent Publication No. 2083726 discloses the use of carbon black for this purpose, while U.S. Pat. Nos. 4,942,141, 4,948,7768, 4,950,639, 4,950,640 and 4,952,552 describe specific classes of infrared dyes for use in this way.

Dye-transfer-media for thermal dye transfer printing comprising a dye donor layer coated directly on a support are found to experience loss of dye by uncontrolled, non-directionalised diffusion into the support during both storage and the actual transfer process. The support often softens during heating and has the inherent property to act as a receiver for the dye. Dye which is lost by this 'wrong way' diffusion results in less dye being transferred to the image receptor. Since the background density in a thermal-dye-transfer system is essentially constant, any increase in density of the transferred dye in image areas results in improved discrimination which is highly desirable.

U.S. Pat. Nos. 4,716,144 and 4,700,208 discloses dye donor elements for thermal dye transfer which comprise a support having on one side thereof a dye donor layer and on the opposite side thereof a slipping layer comprising a lubricating material, a hydrophilic dye-barrier layer located between the dye donor layer and the support, and a subbing layer located between the dye-barrier layer and the support. Any thermally transferable dye(s) may be used in the dye donor elements but sublimable dyes are preferred. The hydrophilic barrier layer is said to prevent bidirectional transfer of dye into the subbing layer/support with the result that the density of the transferred dye is increased. Preferred hydrophilic materials are said to include poly(acrylic acid), cellulose mono-acetate and poly(vinyl alcohol).

Self-supporting ink formulations are known and disclosed, for example, in U.S. Pat. Nos. 4,609,928 and 4,103,066 and in European Patent Publication No. 120230. All the examples relate to mass transfer inks, from which transfer of both colourant and binder to the receptor occurs on heating. Sublimation media, on the other hand, transfer only the colourant to the receptor and thus can yield graded (i.e., grey scale) response to varying thermal energy. The mass transfer process is only bi-level generally.

U.S. Pat. No. 4,857,503 discloses the concept of a dye-transfer-medium comprising a single, self-supporting layer of a polymeric binder having dispersed or dissolved therein a thermally transferable dye. However, there is no actual reduction to practice as it is recognised that such media would transfer much lower amounts of dye, when compared with multilayer dye-transfer-sheets comprising dye and binder coated onto a carrier substrate. This results from the high ratio of binder:dye required to provide the media with sufficient structural integrity. Furthermore, when such media are used in thermal printers, the tendency of the dye to transfer bilaterally, that is, onto the print head as well as the receptor substrate, necessitates more frequent (and often laborious) cleaning and in some cases a reduction in the print head's life expectancy.

The present invention seeks to provide alternative dye-transfer-media.

BRIEF SUMMARY OF THE INVENTION

According to the present invention there is provided a dye-transfer-sheet in the form of a self supporting film having a total thickness of from 4 to 15 μm and consisting of a layer of one or more thermally mobile sublimatin dyes dissolved or dispersed in a polymeric binder and a hydrophilic barrier layer adjacent to, but distinct from the dye-containing layer comprising a polymeric binder substantially impermeable to migration of the sublimable dye(s).

The dye-transfer-sheets of the invention have a high sensitivity due to the absence of a support substrate (with a concomitant reduction in the wear of the print head) and produce clear, high density transferred images upon imaging. Furthermore, there is little if any contamination of the print head by the dyes.

The dye-transfer-sheets of the invention are particularly suitable for the conversion of the black and white output of laser printers to produce a colour image but may be used with other devices, for example:

(i) overhead transparency visuals by combining photocopy and Thermofax processes, (ii) application as a dye donor medium for thermal imaging systems having thermal printheads, and (iii) application as a laser addressed dye donor medium, when a suitable absorber is incorporated with the dye-transfer-sheet of the invention.

Color hardcopy may be produced using the black and white output from laser printers and photocopiers, as disclosed, for example, in U.S. Pat. Nos. 4,006,018 and 4,764,444. In such a process, colour separation images produced with colour filters are converted to black and white copy by a printer or photocopier and are placed in contact with a dye-transfer-medium of the appropriate colour which itself is in contact with an image receptor and irradiated with infrared radiation to cause heating of the sublimation dye medium in the image areas. This results in transfer of the dye to the receptor. Laser printers use a black toner powder based on a carbon dispersion, usually in a binder, such as poly(methylmethacrylate). Carbon has the added property of absorbing in the infrared region, so that when it is used close to a tungsten light source, it efficiently converts the radiant energy into thermal energy for sublimation of dyes. The process is then repeated for the remaining colours using the appropriate colour separation image to generate a full colour hard copy of the original image. Both the laser printer/toner and infrared sublimation stages are fast processes, and can yield an A4 size colour hardcopy in less than 30 seconds.

DESCRIPTION OF PREFERRED EMBODIMENTS

The dye-transfer-sheets of the invention are of bilayer format having a dye donor layer and a separate barrier layer, in which the barrier layer is in intimate association with, but, separate from the dye donor layer. In normal use, the barrier layer is in contact with the heat source (e.g., thermal print head or irradiated toner image) and directs dye transfer away from the heat source. The total thickness of the media may vary between 4 to 15 μm but is preferably from 6 to 10 μm. Reducing the sheet thickness to less than 4 μm increases handling difficulties due to static, film breakage and creasing in an analogous manner to a "cling film" effect.

The barrier layer generally has a thickness of from 1 to 5 μm, preferably 2 to 5 μm, and the dye donor layer a thickness of from 3 to 10 μm.

The dye-transfer-sheets of the invention may be formed by dispersing or dissolving a hydrophilic binder in a suitable solvent, e.g., water or other aqueous solution, and coating the resulting binder preparation onto a carrier substrate to form the barrier layer. If the binder preparation is in the form of a solution, the preferred coating technique is by solvent casting, but for an emulsion other coating procedures, such as knife coating, roller coating etc., may also be used. The dye donor layer is formed by dispersing or dissolving one or more sublimable dyes in a binder solution comprising a polymeric binder dissolved in a suitable solvent. The dye/-binder preparation is coated onto the barrier layer, again typically by solvent casting, and allowed to dry. The composite of dye donor and barrier layers dries to produce a film having self-supporting properties when stripped from the carrier substrate. Alternatively, the coating order may be reversed providing the carrier substrate has suitable release properties with respect to the dye donor layer. The self-supporting properties of the dye-transfer-sheets may be derived from either layer independent of the other or, alternatively, from the combination of both layers. The binder of each layer may optionally be crosslinked using techniques known in the art to provide additional mechanical strength. Preferably, the self-supporting properties derive from either the barrier layer alone or the combination of the two layers so that the binder of the dye donor layer need only be present in an amount sufficient to give the layer cohesive strength instead of the amounts required to provide self-sustaining independent integrity, with a concomitant decrease in the amount of dye available.

In this manner, the percentage of binder in the dye donor layer may be reduced to about 1 to 2% (98 to 99% by weight dye), although a more typical range would be from 20 to 90% by weight dye (80 to 10% by weight binder). The preferred range is from 20 to 70%, more preferably 25 to 60% by weight dye to provide high density transfer, good adhesion between the donor and barrier layers and to inhibit migration of the dye during storage.

The hardened film is peeled away from the substrate prior to use. The film may be stored with the carrier substrate until required or the substrate may be removed shortly after hardening. Both the carrier substrate and the binder of the layer in contact with it are chosen for their peeling properties, for example, poly(-vinyl alcohol) (PVA) may be used as a barrier layer in contact with unsubbed poly(ethylene terephthalate) (PET) as the carrier substrate.

A release agent such as a surfactant may be incorporated within the appropriate layer to facilitate peeling of the dried film from the carrier substrate.

Suitable surfactants include fluorinated chemicals, such as FC-217, FC-233B, FC-248, FC-352, FC-393, FC-396, FC-430, FC-461, FC-807, FC-810 and FC-824, commercially available from the Minnesota Mining & Manufacturing Company and aqueous surfactants, such as Tergitol TMN-10, a polyethylene glycol polyether available from Union Carbide. Other surfactants suitable for inclusion in the barrier layer comprise ionic surfactants (including anionic, cationic and amphoteric surfactants) having one or more polar groups because of the hydrophilic nature of the barrier layer.

Anionic surfactants containing acid groups such as a carboxyl group, a sulpho group, a phospho group, a sulphuric acid ester group, a phosphoric acid ester group etc., may be employed, such as alkylcarboxylates, alkylsulphonates, alkylbenzenesulphonates, alkylnaphthalenesulphonates, alkylsulphuric acid esters, alkylphosphoric acid esters, n-acyl-n-alkyltaurines, sulphosuccinic acid esters, sulphoalkylpolyoxyethylene alkylphenyl ether, polyoxyethylene alkylphosphoric acid esters etc.

Amphoteric surfactants include amino acids, aminoalkylsulphonic acids, aminoalkylsulphuric or phosphoric acid esters, alkylbetaines, amine oxides etc.

Cationic surfactants such as alkylamines, aliphatic or aromatic quaternary ammonium salts, heterocyclic quaternary ammonium salts such as pyridinium salts, heterocyclic quaternary ammonium salts such as pyridinium salts, imidazolium salts etc., aliphatic or heterocyclic ring-containing phosphonium or sulphonium salts, etc. may also be used.

Examples of non-ionic surfactants which may be employed include saponin (steroidal), alkylene oxide derivatives (e.g., polyethylene glycol, polyethylene glycol/polypropylene glycol condensate, polyethylene glycol alkyl ethers, polyethylene glycol alkyl aryl ethers, polyethylene glycol esters, polyethylene glycol sorbitan esters, polyalkylene glycol alkylamines or alkylamides, silicone polyethylene oxide adducts), glycidol derivatives (e.g., alkenylsuccinic acid polyglyceride, alkylphenol polyglyceride), polyhydric alcohol-fatty acid esters, sugar alkyl esters etc.

The choice of surfactant depends on the choice of barrier layer, binder and substrate. For example, for a barrier layer comprising PVA coated on a poly(ethylene terephthalate) substrate, the preferred surfactant is Tergitol TMN-10.

The carrier substrate may comprise any material, whether natural or synthetic, which has a surface, (preferably smooth) having a low affinity for the binder of the layer in contact with it, for example, polyesters, such as (unsubbed) poly(ethylene terephthate), commercially available under the trade name Mylar, and polyethylene naphthalate, poly(sulfones), polycarbonates, cellulose esters, such as cellulose acetate, fluorinated polymers, such as poly(vinylidene fluoride) and poly(tetrafluoroethylene-hexafluoropropylene), polyethers, such as polyoxyethylene, polyacetals, polyolefins, such as polystyrene, polyethylene, polypropylene and methylpentane polymers, polyamides, cellulose papers, glassine paper, condenser paper, polyimides, such as polyimide-amides and polyetherimides, etc. The thickness of the substrate is not critical (e.g., from 10 to 500 μm) but typically is from 60 to 100 μm. The substrate is advantageously reusable following stripping of the dye-transfer-media.

The hydrophilic binder of the barrier layer may comprise any polymeric binder which is substantially impermeable to dye migration, either into or through the barrier layer, thereby ensuring undirectional transfer of dye in the direction of the image receptor substrate during thermal processing. Most of the dyes used in thermal-dye-transfer printing are hydrophobic and therefore have little or no affinity for, or solubility in hydrophilic materials. The binder is also desirably selected for low adhesion to the carrier substrate subsequent to hardening. The binder is preferably solvent castable using water as a solvent. Preferred binders include poly(vinyl alcohol), gelatin, poly(vinyl pyrrolidone), poly(acrylamide), poly(isopropyl acrylamide), butyl methacrylate graft on gelatin, ethyl acrylate graft on gelatin, ethyl methacrylate graft on gelatin, cellulose monoacetate, methyl cellulose, poly(acrylic acid), or a mixture thereof. In a most preferred embodiment, the hydrophilic binder is poly(vinyl alcohol), a mixture of poly(vinyl alcohol) and poly(vinyl acetate) or a mixture of poly(vinyl alcohol) and poly(acrylic acid).

The binder of the dye donor layer may be substantially any film forming polymer, preferably having self-supporting properties, such as poly(vinyl formal) (e.g., those polymers commercially available under the trade name Formvar), poly(vinyl butyral) (e.g., those polymers commercially available under the trade name Butvar), a polycarbonate, poly(styrene-acrylonitrile), a poly(sulfone), a poly(phenylene oxide) and poly(vinylidene chloride-vinyl acetate) copolymers, e.g., VYNS, VAGH etc., or a mixture thereof. Preferred binders are cellulosic binders such as, ethyl cellulose, cellulose acetate, cellulose acetate hydrogen phthalate, cellulose acetate butyrate, cellulose acetate propionates, cellulose triacetate etc. The dye donor layer is usually coated out of an organic solvent, e.g., tetrahydrofuran (THF), methyl ethyl ketone (MEK) and mixtures thereof, MEK/toluene blends and THF/chlorinated solvents. As coating of the dye donor layer should not disturb or disrupt the barrier layer, the exact choice of solvent must also take into account the nature of the hydrophilic binder.

A release agent may also be incorporated within the dye donor layer to reduce adhesion between the binder of the dye donor layer and the image receptor substrate during thermal processing, thereby ensuring efficient separation of the transfer sheet from the receptor and resulting in a clear background, that is a low Dmin. This choice of release agent depends on the nature of the dyes and binder present in the donor layer, but fluorochemicals, e.g., FC-430, are preferred.

In an alternative embodiment, the transfer-sheet may be produced by incorporating a dedicated release layer interposed between the carrier substrate and the layers constituting the transfer-sheet. The release layer may comprise a coating of a polymeric binder incompatible with that of whichever layer of the transfer-sheet is coated first, which incompatibility may be manifested as a reduction in the adhesion between the release layer and the aforesaid layer of the transfer-sheet, thereby facilitating peeling apart of the transfer-sheet from the carrier substrate. The release layer may also include one or more release agents, such as surfactants, etc. to facilitate separation. Accordingly, such media are produced by the successive solvent casting of each layer, e.g., release, barrier and dye donor layer, onto the carrier substrate. Following peeling, the release layer normally remains associated with the carrier substrate, although this is not critical.

Sublimable dyes suitable for use in the invention are soluble or intimately dispersible within the binder of the dye donor layer and are transferable as a vapour at the surface of the polymeric binder or by thermal diffusion, under conditions of heating which do not degrade the dyes or polymer, or cause appreciable transfer of the polymeric binder to the receptor. Transfer of the binder (known as "mass transfer") can lead to excessive light scattering and a change in the perceived hue of the image. Typical heating conditions involve temperatures in excess of 200° C. for periods of up to a few seconds.

The terms "sublimation transfer", "sublimation dye" and "sublimable dye" have traditionally been used in connection with this process, although it is not clear whether sublimation, in the true sense of the word, actually takes place. For example, transfer of the dye may equally well take place by thermal diffusion from the donor to the receptor. Thus it is to be understood that the terms "sublimation dye" and "sublimable dye" as used herein refer to dyes that are capable of thermal transfer from a donor sheet to a receptor sheet without simultaneous transfer of appreciable amounts of binder materials, regardless of the exact mechanism of transfer.

The term "dye"as used in the present invention refers to a compound which absorbs at least some radiation in the visible region of the electromagnetic spectrum with a molar extinction coefficient in a suitable solvent rising at least to 500, and therefore exhibits a colour. The dye may be soluble in water but is more preferably soluble in an organic solvent to prevent dye migration into the hydrophilic barrier layer. The dye does not have to be completely dissolved in the dye donor layer and because of the high percentage of dye used, at least some of the dye may be present as a 'solid' (referred to as pigment). Some of the dye may be present as small crystals of dye. In general, such dyes have low molecular weight, typically from 100 to 800, and an absence of polar groups, especially ionic groups. Suitable dyes are well known in the art, e.g., those dyes disclosed in U.S. Pat. Nos. 4,138,949, 4,847,238. 4,853,365 and 4,857,503 and include azo, indoaniline, anthraquinone, amino-styryl, tricyanostyryl, thiazine, diazine and oxazine dyes.

Anthraquinone dyes useful in the present invention include anthraquinone dyes optionally bearing one or more substituents selected from amino, alkylamino, arylamino, acylamino, aroylamino, alkylsulfonylamino, arylsulfonylamino, hydroxy, alkoxy, aryloxy, alkylthio and arylthio groups each of which groups may, where appropriate, comprise up to 10 carbon atoms, and halogen atoms, e.g., chloro, bromo etc.

Azo dyes useful in the invention include dyes consisting of an azo group substituted with a group A at one end and a group B at the other. Group A consists of an aryl group containing one or more of the following substituents: hydrogen, amino, alkylamino, arylamino, alicyclic amino; or group A consists of a pyridone or a substituted pyridone, e.g., a cyano-substituted pyridone, a hydroxy-substituted pyridone, an alkyl-substituted pyridone. Group B consists of an aryl group containing one or more of the following substituents: hydrogen, hydroxy, alkoxy, aryloxy, substituted aryloxy, alkyl, substituted alkyl, haloalkyl, aryl, substituted aryl, amino, alkylamino, arylamino, substituted arylamino, alicyclic amino, chloro, bromo, thioalkyl, thioaryl, substituted thioaryl, cyano, nitro, acylamino, substituted acylamino, aroylamino; or group B is: a heterocycle, a substituted heterocycle, a furan, a substituted furan, a thiofuran, a substituted thiofuran, a thiazole, a substituted thiazole, a benzothiazole, a substituted benzothiazole, a diazole, a substituted diazole, a benzodiazole, a substituted benzodiazole.

Examples of commercially available dyes include Sumikalon Violet RS (product of Sumitomo Chemical Co., Ltd.), Dianix Fast Violet 3R-FS (product of Mitsubishi Chemical Industries, Ltd.), Kayalon Polyol Brilliant Blue N-BGM, KST Black 146 (products of Nippon Kayaku Co., Ltd.) Kayalon Polyol Brilliant Blue BM, Kayalon Polyol Dark Blue 2BM, KST Black KB (products of Nippon Kayaku Co., Ltd.), Sumikalon Diazo Black 5G (product of Sumitomo Chemical Co., Ltd.), Miktazol Black 5GH (product of Mitsui Toatsu Chemicals, Inc.), Direct Dark Green B (product of Mitsubishi Chemical Industries, Ltd.), Direct Brown M and Direct Fast Black D (products of Nippon Kayaku Co. Ltd.), Kayalon Milling Cyanine 5R (product of Nippon Kayaku Co. Ltd.), Sumicacryl Blue 6G (product of Sumitomo Chemical Co., Ltd) and Aizen Malachite Green (product of Hodogaya Chemical Co., Ltd.).

Eutectic mixtures of dyes, as disclosed for example in U.S. Pat. No. 4,857,503, may also be employed advantageously.

The dye donor layer may also contain additives to help stabilize and solubilize the dye. The additives can be added in concentrations ranging from 0.1% of the total dye concentration to 20% by weight. Such additives include polyurethanes, plasticizers, UV stabilizers, heat stabilizers, surfactants, silicones, low Tg polymers ($Tg < 80°$ C.) and elastomers.

In addition, the dye donor layer, the barrier layer, or both, may contain an infrared absorbing material to facilitate direct imaging by a laser instead of a thermal printing head. In such a system, the transfer-sheet includes a material which strongly absorbs at the wavelength of the laser. When the donor is irradiated, the absorbing material converts light energy to thermal energy and transfers the heat to the dye in its immediate vicinity, thereby heating the dye to its vapourization temperature for transfer to a receptor sheet. The absorbing material is preferably admixed with the sublimable dye. The laser beam is modulated by electronic signals representative of the shape and colour of the original image, so that each dye is heated to cause volatilisation only in those areas in which its presence is required on the receptor to reconstruct the colour of the original image. Further details of this process are found in British Patent Publication No. 2083726.

Such absorbing materials should either be non-sublimable or have no visible absorption, to avoid contamination of the image. Examples of such materials include carbon black (as disclosed in British Patent Publication No. 2083726), squarylium dyes (as disclosed in U.S. Pat. No. 4,942,141), bis(chalcogenopyrylo)polymethine dyes (as disclosed in U.S. Pat. No. 4,948,777), oxyindolizine dyes (as disclosed in U.S. Pat. No. 4,948,778), bis-(aminoaryl)polymethine dyes (as disclosed in U.S. Pat. No. 4,950,639) merocyanine dyes (as disclosed in U.S. Patent Specification No. 4,950,640), and quinol dyes derived from anthraquinones and naphthoquinones (as disclosed in U.S. Pat. No. 4,952,552).

Several different kinds of laser may be used to effect the thermal transfer of dye from a dye-transfer-sheet incorporating such materials to a receptor sheet, e.g., argon and krypton lasers; metal vapour lasers such as copper, gold and cadmium lasers; solid state lasers such as ruby or YAG lasers; or diode lasers such as gallium arsenide lasers emitting in the infrared region from 750 to 870 nm. However, in practice, the diode lasers offer substantial advantages in terms of their small size, low cost, stability, reliability, ruggedness and ease of modulation. Moreover, before any laser can be used to heat a dye-transfer-sheet, the laser radiation must be absorbed into the dye layer and converted to heat by a molecular process known as internal conversion. Thus, the construction of a useful dye layer will depend not only on the hue, sublimability and intensity of the image dye, but also on the ability of the dye layer to absorb the radiation and convert it to heat.

Lasers which can be used to transfer dye from the dye-transfer-sheets of the invention are available commercially, for example, Laser Model SDL-2420-H2 from Spectrodiode Labs and Laser Model SLD 304 V/W from Sony Corporation.

TABLE 1

Preferred sublimable dyes are shown in Table 1 below:

| COLOUR | EXAMPLES OF DYE | |
|---|---|---|
| MAGENTA | A | B |
| | 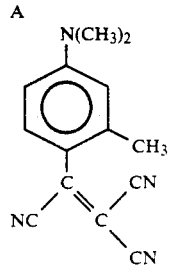 | 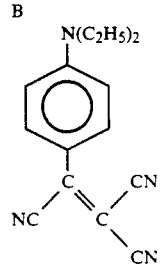 |
| CYAN | C | D |

TABLE 1-continued

| Preferred sublimable dyes are shown in Table 1 below: | |
|---|---|
| COLOUR | EXAMPLES OF DYE |
| | 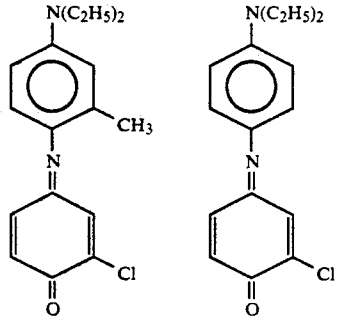 |
| YELLOW | E 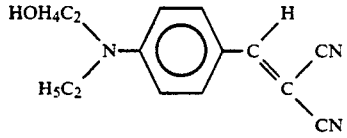 |
| | F 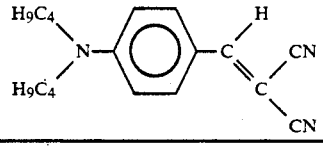 |

The dye-transfer-sheets of the invention may be used in a sheet size embodiment or in a continuous roll form such as a continuous web or ribbon. If a continuous ribbon or roll is used it may have one or several colour coatings on the surface of the support. The dye layer may be coated in a continuous layer or can be sequentially arranged colours. Dyes used in the latter arrangement are usually yellow, cyan and magenta, and sometimes black, but are not necessarily limited to these colours as such. A black sublimable medium may be produced, for example, by combining Dye A, Dye C and Dye E in the dye donor layer in the proportions 10:11:8 by weight. The construction may be coated in sequentially arranged colours so as to provide a three colour dye transferred image.

The dye-transfer-sheets of the invention are placed in contact with an image receptor substrate, and selectively heated in accordance with image information whereby the dye(s) is transferred to the receptor substrate.

The image receptor substrate used with the dye-transfer-sheets of the invention usually comprises a support having on at least one surface thereof a dye-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as barytacoated paper, white polyester (polyester with white pigment incorporated therein), an ivory paper, a condenser paper or a synthetic paper.

The dye-receiving layer may comprise, for example, a polycarbonate, a polyurethane, a polyester, polyvinyl chloride, poly(styrene-co-acrylonitrile), poly(caprolactone) poly(vinylidene chloride vinylacetate) or mixtures thereof. The dye-receiving layer may be present in any amount which is effective for the intended purpose. In general, good results have been obtained at a coating weight of from about 1 to 5 g/m$^2$.

To hold sufficient dye in the donor sheet, and thereby to achieve the potential for a high density transfer of the dye to the receptor sheet, it is essential that (1) the dye is readily soluble or dispersible in the donor sheet medium, (2) the dye concentration is maintained in the dye donor sheet at the highest possible percentage, (3) the dye donor construction has a prolonged shelflife potential, and (4) the dye demonstrates a high degree of transfer efficiency to the dye receptor sheet.

It is highly desirable to use sublimable dyes that are readily dispersed as solids or dissolved in the donor medium in order to prevent the dye crystal size from becoming large enough to adversely affect shelflife and transferability.

Thermal printing heads which can be used to transfer dye from the dye-transfer-sheets of the invention are available commercially, e.g., a Fijitsu Thermal Head (FTP-040 MC5001), a TDK Thermal Head (F415 HH-b 7-1089) or a Rohm Thermal Head (KE 2008-F3) but a preferred thermal print head is disclosed in our co-pending European Patent Application No. 90308954.8 filed on Aug., 15, 1990.

The heat transfer of the dye allows formation of a dye image having high colour purity. The process is dry and takes only 2–20 msecs/line or less to give a colour image. The process may be used to achieve a multi-colour image either by sequentially transferring dyes from separate dye-transfer-sheets or by utilizing dye-transfer-sheets having two or more colours sequentially arranged on a continuous web or ribbon-like configuration.

Alternatively, the dye-transfer-sheet may be assembled with the barrier layer in contact with a toner image and the latter exposed to infrared radiation. Absorption of radiant energy by the toner results in localized heating and transfer of dye from areas corresponding to the toner image.

The invention will now be illustrated by the following Examples.

"Mylar", "Tergitol", "Magic Tape", "Thermofax", "Butvar", "Formvar", "Sumikalon Violet RS", "Dianix Fast Violet 3R-FS", "Kayalon Polyol Brilliant Blue N-BGM", "Kayalon Polyol Brilliant Blue BM", "Kayalon Polyol Dar Blue 2BM", "KST Black 146", "KST Black K8", "Sumikalon Diazo Black 5G", "Miktazol Black 5GH", "Direct Dark Green B", "Direct Brown M", "Direct Fast Black D", "Milling Cyanine 5R", "Sumicacryl Blue 6G", "Aizen Malachite Green", "Laser Model SDL-2420-H2" and "Laser Model SLD 304 V/W" are all trade names.

EXAMPLE 1

A coating of aqueous PVA (10ml, 8% w/w containing 1 ml Tergitol TMN-10 (10%)) was made with K-Bar 6 on an unsubbed PET base. The coating was dried for 2 hours at 58° C. Dye D (0.5 g) in a solution of 10 ml ethyl cellulose (10% w/w) and 10 ml VYNS (10% w/w) was coated onto the dried PVA layer. The resulting bi-layer coating was dried for a further hour at 50° C., before removal by application of pressure sensitive tape, commercially available from the Minnesota, Mining & Manufacturing Co., under the trade name "Magic Tape", as a self-supporting film. The tape was applied to the coating edge and the adhesion between tape and coating used to lever the coating off the PET carrier substrate. The film was contacted with a toner image produced by a Laser Jet II printer onto Transparency Type 154, commercially available from the Minnesota, Mining & Manufacturing Co., and the composite of transparency and dye film overlaid on an image receiving substrate. The receptor for receiving the dye image was a coating of poly(vinylidene chloride-vinyl acetate) containing $SiO_2$ particles (10% w/w solution coated out of methyl ethyl ketone (MEK)) onto a 2½ mil (64 μm) PET base.

The composite of; Type 154 transparency bearing the toner image, sublimable dye medium and image receptor was thermofax treated by passage through a Thermofax "Secretary" Model at "Dark" setting. The toner comprising a carbon base material, absorbs radiant infrared energy causing thermal transfer of dye from the dye donor layer to the receptor at points corresponding to the original toner image.

Dye transfer, i.e., an O.D. of approximately 2.0 and dot rendition were found to be consistently good.

EXAMPLE 2

Comparative Examples for Substrate Coated Sublimation Dye Media

1. Comparative Coatings on Paper Substrate

Rhinelander paper grades of 7.6, 8.2, 13.6 and 15.9 kg per 2.8 $km^2$ (16.7, 18, 30 and 35 lb per 30 $kft^2$ respectively) were tested. A solution of Dye D (0.5 g) in 10 ml ethyl cellulose (10%) and 10ml VYNS (10%) was coated with K-Bar 6 onto the above paper grades. Each coating was dried in air for 1 hour. The coated papers were fed into a Laser Jet Printer and a toner image deposited on the reverse of the dye coating.

A composite was made with an image receptor comprising a coating (2 μm) of VYNS on unsubbed 4 mil (102 μm) PET, coated out of MEK. The composite was passed through a "Secretary" Model Thermofax set at "Dark" and the receptor sheet analysed for both transferred dye density and the quality of dot rendition. The results are presented in Table 1 below.

TABLE 1

Comparative Performance of Coatings on Paper Substrate

| Paper Weight (kg/2.8 $km^2$) | Toner Pick-Up Performance | Dye Density | Dot Structure |
|---|---|---|---|
| 7.6 | * | 2.0/High Dmin** | 5% |
| 8.2 | 100% | 1.8 | none |
| 13.6 | 100% | 1.7 | none |
| 15.9 | 100% | 1.7 | none |

*Paper jams in Laser Jet: too thin for transport.
**Dmin is dye sublimation in untoned areas.

The results show that while the thinnest paper transfers the dye well, a poor Dmin is produced due to heating in untoned areas in this particular equipment. Similarly, movement of the thicker papers during processing results in a loss of dot quality and therefore produces a poor image. Although line and text toner images are adequately transferred, finely resolved images, i.e., comprising dots of approximately 50 μm or less are not.

2. Comparative Coatings on PET Substrate

The dye solution described in Example 2(1) was coated onto the following polymer substrates (see Table 2) with K-Bar 6 coating thickness and dried for 1 hour.

The coating on the thin 6 μm PET substrate was achieved by first coating the PET onto a rubber coating bed using ethanol to laminate the substrate temporarily and evenly to the bed. The dye solution was then coated as described in Example 1.

The tests described in Example 2 (1) were performed on the three films and the results recorded in Table 2 below.

The results show that although a thin substrate is necessary to achieve satisfactory dot copy, there is a concomitant decrease in film handling and coating properties which need much improvement.

TABLE 2

| Substrate Type & Thickness | Toner Image | Dye Density | Dot Structure |
|---|---|---|---|
| PET 6 μm | 100%* | 1.8/considerable Dmin and ripple effects | 5% |
| PET 64 μm (2½ mil) | 100% | 1.0/considerable Dmin and ripple effects | none |
| PET 64 μm (2½ mil) | 100% | 0.3/considerable Dmin and ripple effects | none |

*Thin film was taped to Bond paper carrier before film fed into Laser Jet.

We claim:

1. A dye-transfer-sheet in the form of a self supporting film having a total thickness of from 4 to 15 μm and consisting of a layer of one or more thermally mobile sublimation dyes dissolved or dispersed in a polymeric binder and a hydrophilic barrier layer adjacent to, but distinct from the dye-containing layer comprising a polymeric binder substantially impermeable to migration of the sublimable dye(s).

2. A dye-transfer-sheet according to claim 1 wherein said barrier layer and/or said dye-containing layer further comprises a release agent.

3. A dye-transfer-sheet according to claim 2 wherein said release agent is a surfactant.

4. A dye-transfer-sheet according to claim 3 wherein said surfactant is a fluorinated chemical.

5. A dye-transfer-sheet according to claim 1 wherein the barrier layer comprises a binder which is a member selected from the group consisting of poly(vinyl alcohol), gelatin, a graft of butyl methacrylate, ethyl methacrylate or ethyl acrylate on gelatin, poly(vinyl pyrrolidone), poly(acrylamide), poly(isopropylacrylamide), cellulose monoacetate, methylcellulose, poly(acrylic acid) and mixtures thereof.

6. A dye-transfer-sheet according to claim 5 wherein said binder is a member selected from the group consisting of poly(vinyl alcohol), a mixture of poly(vinyl alcohol) and poly(vinyl acetate) or a mixture of poly(vinyl alcohol) and poly(acrylic acid).

7. A dye-transfer-sheet according to claim 1 wherein said dye-containing layer has a thickness of from 3 to 10 μm.

8. A dye-transfer-sheet as claimed in claim 7 wherein said barrier layer has a thickness of from 1 to 5 μm. .

9. A dye-transfer-sheet as claimed in claim 8 wherein the total thickness of the sheet is from 6 to 10 μm.

10. A dye-transfer-sheet according to claim 1 wherein the dye-containing layer comprises a binder which is a member selected from the groups consisting of poly(vinyl butyral), poly(vinyl formal), poly(vinylidene chloridevinyl acetate) copolymers, a cellulosic binder, a polycarbonate, poly(styrene-acrylonitrile), a poly(sulfone), poly(phenylene oxide) and mixtures thereof.

11. A dye-transfer-sheet according to claim 10 wherein said binder is a member selected from the group consisting of ethyl cellulose, cellulose acetate hydrogen phthalate, cellulose acetate, cellulose triacetate, cellulose acetate propionate or cellulose acetate buyrate.

12. A dye-transfer-sheet according to claim 1 wherein said thermally mobile sublimation dye is selected from:

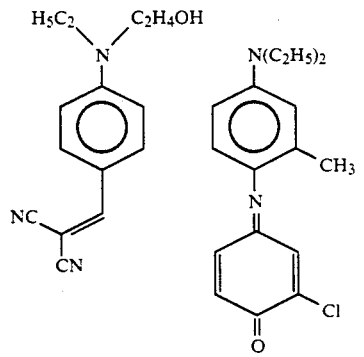

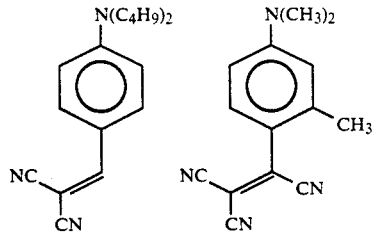

-continued

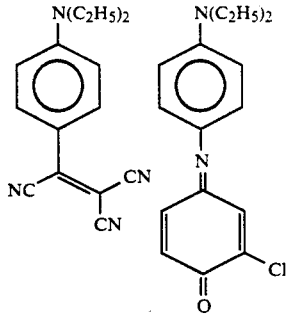

13. A dye-transfer-sheet according to claim 1 wherein said dye-containing layer additionally comprises infrared-absorbing material to facilitate direct imaging by laser.

14. A dye-transfer-sheet according to claim 13 wherein said infrared-absorbing material is a member selected from the group consisting of carbon black, squarylium dyes, bis(chalcogen-opyrylo)polymethine dyes, oxyindolizine dyes, bis(aminoaryl)polymethine dyes, merocyanine dyes and quinol dyes derived from anthraquinones and naphthoquinones.

15. A method of generating an image which comprises the steps of:

(i) providing a dye-transfer-sheet in the form of a self supporting film having a total thickness of from 4 to 15 μm and consisting of a layer of one or more thermally mobile sublimation dyes dissolved or dispersed in a polymeric binder and a hydrophilic barrier layer adjacent to, but distinct from the dye-containing layer comprising a polymeric binder substantially impermeable to migration of the sublimable dye(s), (ii) placing said dye-transfer-sheet in contact with the surface of a receptor, (iii) generating a thermal image in the dye-transfer-sheet sufficient to transfer dye from the dye-transfer-sheet to the receptor, and (iv) removing the dye-transfer-sheet from the receptor.

16. A method according to claim 15 wherein said surface of the receptor comprises a layer of poly(vinylidene chloride) containing $SiO_2$ particles.

17. A method according to claim 15 wherein said thermal image is generated by a thermal print head.

18. A method aocording to claim 15 wherein said thermal image is generated by placing a toner image in contact with the dye-transfer-sheet and irradiating the toner image with infrared radiation.

19. A method according to claim 18 wherein said dye-transfer-sheet comprises an infrared absorbing material and the thermal image is generated by a laser.

* * * * *

UNITED STATES PATENT AND TRADEMARK OFFICE

CERTIFICATE OF CORRECTION

PATENT NO. : 5,246,909

DATED : September 21, 1993

INVENTOR(S) : Thien et al.

It is certified that error appears in the above-indentified patent and that said Letters Patent is hereby corrected as shown below:

Column 2, line 53, delete "sublimatin" and insert --sublimation--.

Column 10, line 48, delete "Dar" and insert --Dark--.

Column 14, line 49, delete "aocording" and insert --according--.

Signed and Sealed this

Twenty-seventh Day of September, 1994

*Attest:*

Bruce Lehman

BRUCE LEHMAN

*Attesting Officer*

*Commissioner of Patents and Trademarks*